United States Patent [19]

Laney

[11] Patent Number: 4,572,012

[45] Date of Patent: Feb. 25, 1986

[54] PORTABLE WALKING BEAM PUMP JACK

[76] Inventor: Roy N. Laney, 1007 Rebecca Rd., Frederick, Okla. 73542

[21] Appl. No.: 434,725

[22] Filed: Oct. 18, 1982

[51] Int. Cl.[4] ..... F16H 21/32

[52] U.S. Cl. ..... 74/41; 173/23; 280/764.1

[58] Field of Search ..... 74/41; 280/764.1; 173/23, 28; 52/122.1, 126.1, 126.4, 126.6, 126.7

[56] References Cited

U.S. PATENT DOCUMENTS

| | | | |
|---|---|---|---|
| 121,120 | 11/1871 | Nelson | 74/41 |
| 295,413 | 3/1884 | Martin | 173/28 |
| 795,534 | 7/1905 | McCain | 173/28 |
| 1,621,636 | 3/1927 | Lane et al. | 173/23 |
| 2,084,686 | 6/1937 | Howard | 173/23 |
| 2,516,182 | 7/1950 | Bury | 173/28 |
| 2,523,444 | 9/1950 | Moseley | 74/41 |
| 2,732,197 | 1/1956 | Cornett | 173/23 |
| 2,904,310 | 9/1959 | Leonard | 173/28 X |
| 2,939,681 | 6/1960 | Owen | 74/720 X |
| 2,968,841 | 1/1961 | Vance | 52/126.7 X |
| 3,003,787 | 10/1961 | Woolslayer et al. | 280/764.1 |
| 3,198,263 | 8/1965 | Reischl | 173/26 |
| 3,364,755 | 1/1968 | Miller | 74/41 |
| 3,406,581 | 10/1968 | Eyler et al. | 74/41 |
| 3,438,450 | 4/1969 | Failing | 173/28 X |
| 3,621,723 | 11/1971 | Miller | 74/41 |
| 3,700,047 | 10/1972 | Gartner | 173/28 |
| 3,844,582 | 10/1974 | Cook | 280/764.1 |
| 3,867,846 | 2/1975 | Cambern | 74/41 |
| 3,924,876 | 12/1975 | Vaillant et al. | 280/764.1 |
| 4,321,837 | 3/1982 | Grigsby | 74/41 |
| 4,324,077 | 4/1982 | Woolslayer | 173/23 X |
| 4,336,840 | 6/1982 | Bailey | 173/28 X |
| 4,375,892 | 3/1983 | Jenkins et al. | 173/23 X |

*Primary Examiner*—Leslie A. Braun
*Assistant Examiner*—Dwight G. Diehl
*Attorney, Agent, or Firm*—Christopher H. Morgan

[57] ABSTRACT

A portable walking beam pump jack for use in pumping liquids from an oil well having an elongated frame and an axle with wheels thereon mounted transversely on the frame for providing rolling transportation. Stabilizer pads are provided for securing the frame with respect to a ground location, after transportation. An engine is mounted on the frame and rotates a counterweighted pair of arms which are journalled for rotation adjacent to the frame and parallel to the longitudinal axis of the frame. A drive yoke is connected between the counterweighted arms and a walking beam such that rotation of the arms drives the walking beam in a rocking motion. A foldable support assembly is mounted upon the frame and supports the walking beam. The walking beam can be connected to a sucker rod for pumping from a well. The support assembly is foldable from a first, fixed position in which the walking beam is raised for rocking in a pumping motion to a second, fixed position in which the walking beam is held in a lowered position for transportation. Preferably raising and lowering the support assembly is achieved by means of a hydraulic cylinder which extends from the frame to the support assembly.

3 Claims, 6 Drawing Figures

PORTABLE WALKING BEAM PUMP JACK

BACKGROUND OF THE INVENTION

1. Field of the Invention

This invention relates in general to walking beam pump jacks and more particularly to walking beam pump jacks for use in oil well pumping and the like.

2. Description of the Prior Art

At the present time there are several types of pumps which are used for pumping liquids from oil and gas wells. These pumps include walking beam pump jacks, hydraulic rod-lifting pumps and down-hole hydraulic pumps. The down-hole hydraulic pumps operate by pumping a motive fluid through a conduit down into a well. The hydraulic fluid drives the mechanism of an elongated pump which resides at a desired depth of the well. Well fluids and the hydraulic fluid are conveyed to the surface in a conduit or conduits separate from that which conveys the hydraulic fluid down to the pump. These down-hole hydraulic pumps are generally used for short term pumping at remote locations.

Another type of pump which has been used for short term, remote location pumping is the hydraulic, rod-lifting pump. These pumps reciprocate a pumping rod, often called a sucker rod, which extends through the well bore from the surface to a desired depth. Attached to the bottom of the sucker rod is a one way valve which lifts liquid on the upstroke and gathers more liquid for lifting on the downstroke. The hydraulic lifter at the surface comprises a horizontally journalled pulley over which a cable extends. The ends of the pulley are connected to hydraulic cylinders which can raise and lower the pulley along a vertical frame. One end of the cable is fixed and the other is attached to the sucker rod so that as the pulley is raised and lowered, the sucker rod is raised and lowered as well.

The hydraulic rod-lifting pump has been made portable by mounting the vertical pulley frame, hydraulic cylinders, and hydraulic pumps on a trailer which can be towed to a well location. The vertical pulley frame has been pivotally attached so that it can be laid down during transportation. However, heavy pumping loads on the hydraulic cylinders has made these devices short lived. Also, this method of pumping is not as rapid or as efficient as presently available walking beam pump jacks. Accordingly, it has only been used for temporary, remote location pumping.

Walking beam pump jacks are generally used only for longer term pumping at wells which are more accessible. This is because the walking beam pump jacks have heretofore been not easily transported and are more or less permanently affixed to a well location when they are used.

Walking beam pump jacks operate by reciprocating a sucker rod which extends from the surface through a well bore to a one way valve. Reciprocation of the sucker rod pumps liquids in the same manner as the reciprocation of the sucker rod in a hydraulic rod-lifting pump.

The walking beam pump jacks in present use obtain a significant advantage over other pumps by use of a fixed-mount, long-stroke walking beam driven by a counterweighted rotating drive. The walking beam is mounted on a relatively tall support. An assembly for attaching the sucker rod to the walking beam is disposed at one end of the walking beam. Attached to the other end of the walking beam and extending downwardly is a drive yoke which extends from the walking beam to a pair of counterweighted drive arms. These drive arms rotate about an axis at one end of the arms. A diesel or propane engine drives the arms to rotate which, in turn, rocks the walking beam as a result of the motion of the yoke.

The walking beam must be mounted in a relatively high position because there must be room for the yoke and drive arms to extend and rotate beneath one end of the walking beam. The drive arms must be relatively long and counterweighted by a relatively heavy counterweight in order to produce a proper reciprocating stroke of the sucker rods and in order to lift the relatively large weight of the sucker rod string. Because of this relatively large height, conventional walking beam pump jacks can not be transported over most highways. Bridges and other obstructions prevent the transportation of devices as tall as a conventional walking beam pump jack. Moreover, the heavy equipment and frame components have prevented easy transportation of these type of pumps. Therefore, walking beam pump jacks have only been used for long term pumping and the pumps have been assembled at the well cite on more or less permanent foundations.

While walking beam pump jacks are the preferred devices for pumping from most deep wells and oil wells, it has been impossible or uneconomical to use such pumps for short periods or in remote locations. This is because these pumps must be assembled at the well location and are relatively difficult to move.

SUMMARY OF THE INVENTION

It is accordingly an object of the present invention to provide a portable walking beam pump jack unit. It is also an object of the present invention to provide such a portable walking beam pump jack which can be folded to a transportable height and raised to a pumping height.

Yet another object of the present invention is to provide a portable walking beam pump jack which can be quickly and inexpensively moved from one well pumping operation to another.

Still another object of the present invention is to provide an improved walking beam support assembly and an improved walking beam frame and drive assembly.

To achieve these objects, the portable walking beam pump jack of the present invention comprises an elongated frame preferably comprised of a pair of connected, horizontal, spaced apart beams. Ground engaging wheel means, preferably an axle and a set of wheels, are connected to the frame for supporting the frame during transportation over a ground surface. A stabilizing means is attached to the frame for securing the frame with respect to a ground location. Preferably the stabilizing means comprises front and rear pads which can be hydraulically lowered to engage the ground surface and secure the frame with respect to the surface.

The walking beam of the present invention has a first end, a midportion, and a second end, the second end being adapted for connection to a pumping rod. A counterweighted, rotating drive means is mounted on the frame and connected to the first end of the walking beam for rocking the walking beam in a pumping motion. In order to raise and lower the walking beam for pumping and transportation, respectively, a support assembly is foldably mounted on the frame. The midportion of the walking beam is pivotally connected upon the support assembly and is raised and lowered with the support assembly. The support assembly is foldable from a first, fixed position in which the walking beam is supported in a raised position for rocking in a pumping motion to a second, fixed position in which the walking beam is held in a lowered position for transportation.

The support assembly preferably comprises first, second and third legs each having first and second ends. The first ends of the legs are joined at the pivotal connection to the walking beam. The second ends of the first and second legs are pivotally connected to one end of the frame. The second end of the third leg can be connected to either of two locations on the frame. The first position secures the support assembly and walking beam in a raised position for pumping and the second position secures the support assembly and walking beam in a second, lowered position for transportation.

The drive means for the walking beam pump jack of the present invention preferably comprises an engine mounted on the frame and connected to a pair of journalled drive arms which rotate just outside of the parallel beams of the frame.

For a further understanding of the invention, and further objects, features and advantages thereof, reference may now be had to the following description taken in conjunction with the accompanying drawings.

DESCRIPTION OF PREFERRED EMBODIMENTS

Figure 1:
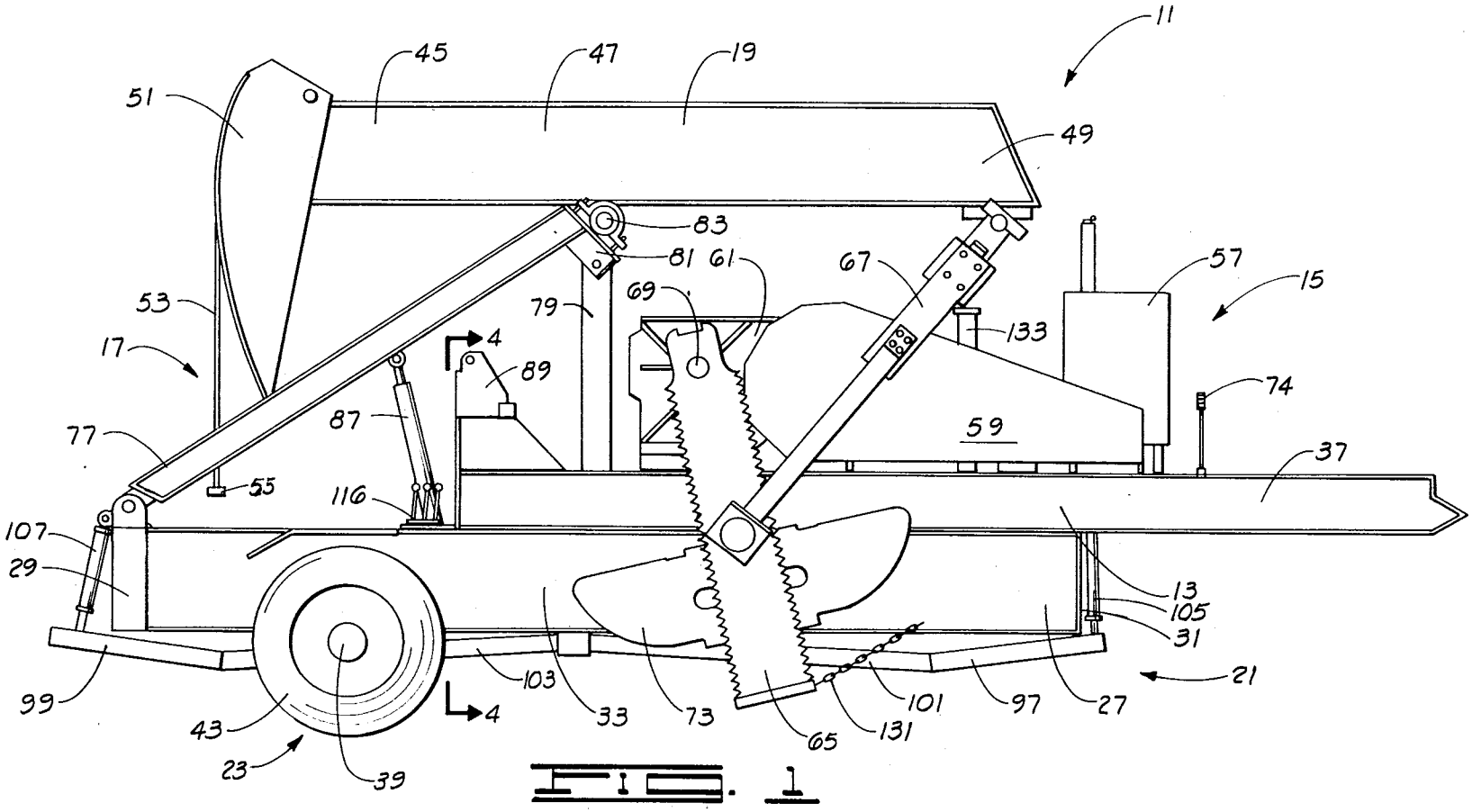
FIG. 1 is a side elevational view of a portable walking beam pump jack constructed in accordance with the present invention.
Figure 2:
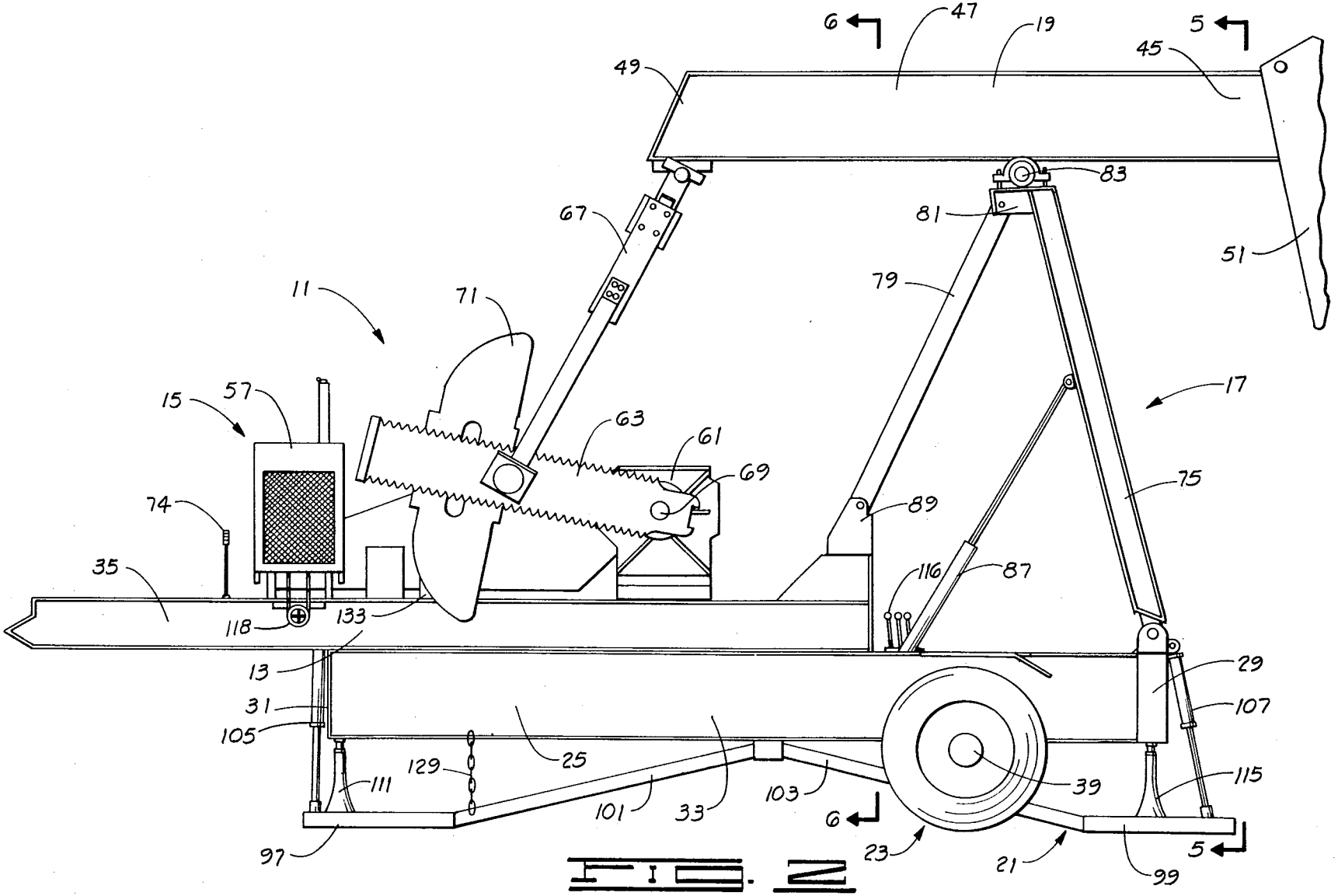
FIG. 2 is a side elevational view of the opposite side of the pump jack of FIG. 1.
Figure 4:
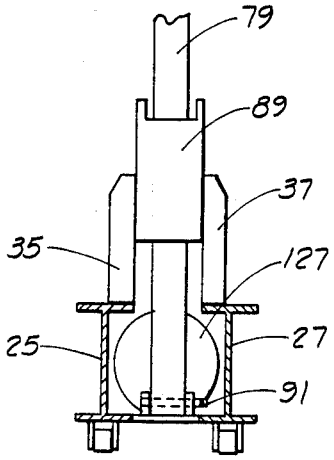
FIG. 4 is a cross-sectional view of the pump jack taken along lines 4—4 shown in FIG. 1.
Figure 3:
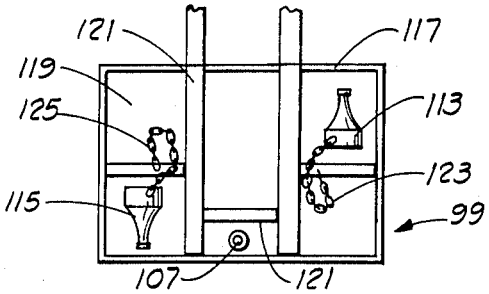
FIG. 3 is a plan view of a pad portion of the pump jack shown in FIGS. 1 and 2.
Figure 5:
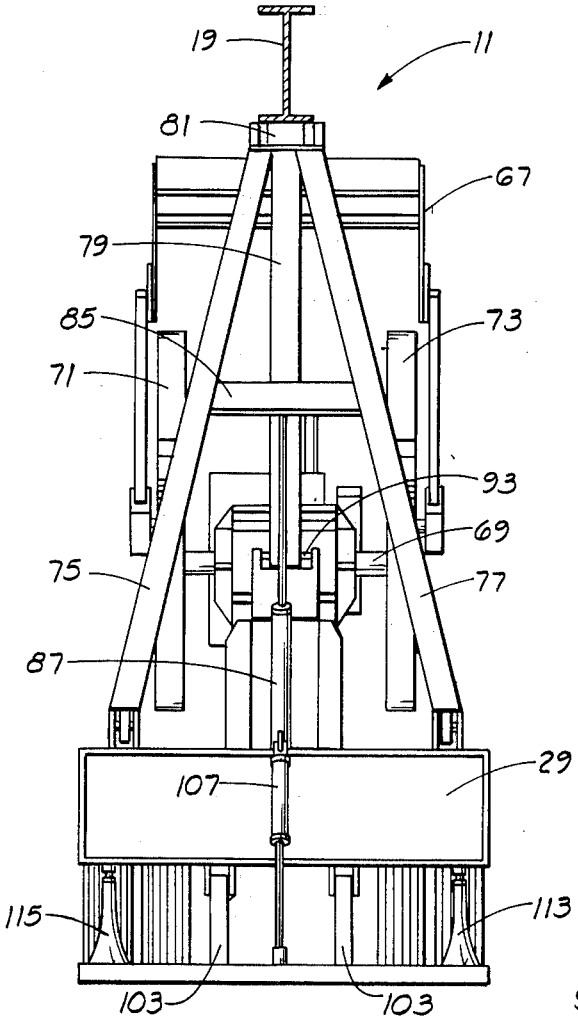
FIG. 5 is a cross-sectional view of the pump jack taken along lines 5—5 shown in FIG. 2.
Figure 6:
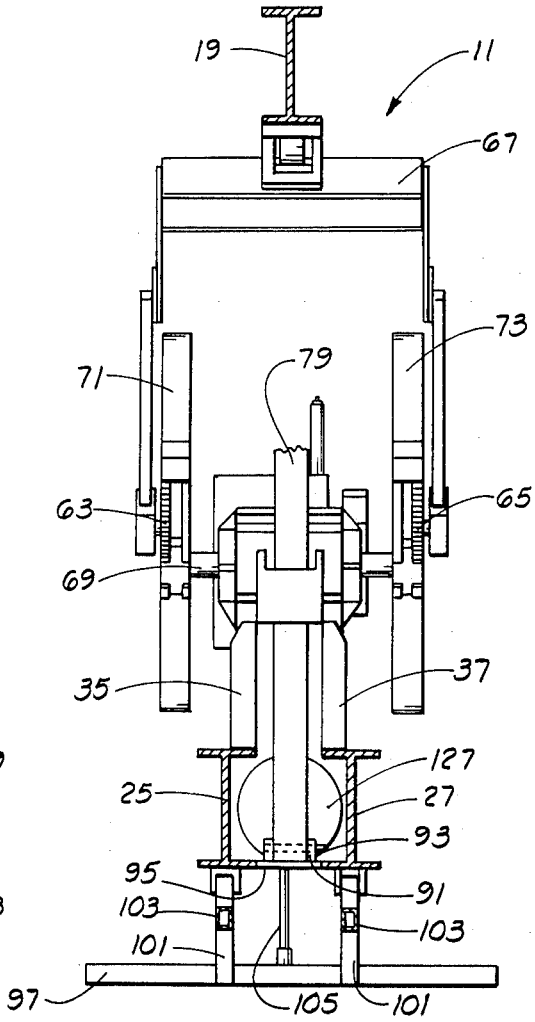
FIG. 6 is a cross-sectional view of the pump jack taken along lines 6—6 shown in FIG. 2.

Referring now to FIGS. 1 through 6, the pump jack 11 of the present invention includes a frame 13, a drive assembly 15, a support assembly 17, a walking beam 19, a stabilizing assembly 21 and a wheel assembly 23. The wheel assembly 23 is connected to the frame 13 and supports the pump jack 11 during transportation. The stabilizing assembly 21 is mounted to the bottom of the frame 13 and is movable from a transportation position to a ground engaging position for stabilizing the frame 13 during pumping. The drive assembly 15 is mounted upon the frame 13 and connected to the walking beam 19 to rock the walking beam 19 in a pumping motion. The support assembly 17 is mounted upon the frame 13 and is movable from a first fixed position for pumping to a second fixed position for transportation. The walking beam 19 is pivotally mounted to the top of the support assembly.

The frame 13 is comprised of a pair of I-beams 25 and 27. The I-beams 25 and 27 extend horizontally in a spaced apart, parallel relationship. They are disposed for mainly supporting vertical loads. The beams 25 and 27 are connected at their ends by a rear plate 29 and a front plate 31. The front and rear plates 31 and 29 extend transversely to the beams 25 and 27 and these plates and beams, together, form an elongated box 33.

The frame 13 also includes a second pair of I-beams 35 and 37. These beams are welded or bolted to the top of the beams 25 and 27. The beams 35 and 37 extend horizontally and parallel to each other in a spaced apart relationship. The beams 35 and 37 extend from just behind the middle horizontal axis of the beams 25 and 27 out beyond the front plate 31. The front of the beams 35 and 37 form a cantilevered towing connection extending horizontally from the top of box 33. The beams 35 and 37 also support the drive assembly 15 and a portion of the support assembly 17.

The wheel assembly 23 includes an axle 39 and two pairs of wheels 41 and 43. The axle 39 is fixedly connected beneath a relatively rear portion of beams 25 and 27. The wheels 41 are located just outside of beam 25 and the wheels 43 are located just outside of beam 27. During transportation, the wheels 41 and 43 are the only portion of the pump jack 11 which contacts the ground so that the pump jack is free to roll upon the wheels 41 and 43.

The walking beam 19 of the present invention is an I-beam having a rod connection end 45, a midportion 47 and a drive connection end 49. The rod connection end 45 has a curved head 51 and cables 53 extending along the curved portion of the head 51. The lower end of the cables 53 are connected to a sucker rod clamp 55. As is well known in the art, the curved head 51 and cables 53 provide a proper vertical reciprocating motion to a sucker rod string connected to the clamp 55 in response to rocking motion of the walking beam 19.

The walking beam 19 is pivotally mounted to the support assembly 17 at its midportion 47. This pivotal connection is oriented for rocking the walking beam 19 in the same plane as the longitudinal axis of the box 33.

The drive assembly 15 includes a diesel engine 57, a drive train 59, transmission 61, a pair of drive arms 63 and 65, and a yoke 67. The engine 57 is mounted on top of beams 35 and 37 above front plate 31. The transmission 61 is mounted on beams 35 and 37 between the rear of the beams and the engine 57. The drive train 59 and its housing extend between the engine 57 and the transmission 61.

The drive arms 63 and 65 are journalled by a shaft 69 to the transmission 61. The shaft 69 extends transversely through the transmission 61 with respect to the frame 13. The arms 63 and 65 rotate about shaft 69 in planes parallel to the longitudinal axis of the box 33. Arm 63 rotates just outside of I-beam 25 and drive arm 65 rotates just outside of I-beam 27.

The drive arms 63 and 65 have counterweights 71 and 73 movably attached thereto. The counterweights balance the weight of the sucker rod which is attached to the clamp 55. By moving the counterweights either toward or away from the shaft 69 the counterweight applied as necessary to balance the sucker rod can be varied.

The yoke 67 is journalled to the midportion of each of the arms 63 and 65 for rotation outside of the arms. Opposite the connection to the arms 63 and 65, the yoke 67 is pivotally connected to the drive connection end 49 of the walking beam 19. When the walking beam 19 is in a raised position for pumping, the yoke 67 extends generally downwardly from the walking beam 19 and the transmission 61 is located beneath the drive connection end 49 of walking beam 19.

The transmission 61 has a disc brake for stopping rotation of the arms 63 and 65. A brake lever 74 is mounted on the frame 13 in front of engine 57 and is connected for actuating the brake for the transmission.

The support assembly 17 of the pump jack 11 includes two rear legs 75 and 77 and a front leg 79. These three legs are joined at a base plate 81 upon which is mounted a spindle 83 which forms the pivotal connection to the walking beam 19. The rear legs 75 and 77 are fixedly connected to base plate 81 whereas leg 79 is pivotally connected to base plate 81. The rear legs 75 and 77 are coplanar and are joined by a cross-bar 85 midway along their length. The lower end of legs 75 and 77 are spaced apart and connected pivotally to the rear plate 29 of frame 13. Thus, the legs 75 and 77, the cross-bar 85, and the base plate 81 together form an A-frame which pivots forwardly and backwardly with respect to the elongated box frame 33.

An hydraulic cylinder 87 is connected between the frame 13 and the cross-bar 85 to raise and lower in an arcuate motion the legs 75 and 77, the base plate 81 and the walking beam 19. The hydraulic cylinder 87 is connected at its piston end to the cross-bar 85 and at its cylinder end to a spanning bar which transversely spans the beams 25 and 27 just behind the rear of beams 35 and 37. These connections are pivotal connections to allow the arcuate motion. When the support assembly is lowered it moves forwardly and downwardly in an arcuate motion to make the jack 11 shorter in length and height.

The lower end of front leg 79 can be coupled to the frame 13 in either of two locations in order to fix the support assembly in a raised, pumping position or in a lowered, transportation position. The frame 13 includes seats 89 and 91 for these two couplings. A coupling pin 93 extends through the lower end of forward leg 79 and either seat 89 or 91 to accomplish the coupling.

Seat 89 is mounted upon the rear of beams 35 and 37 in a raised position approximately the height of the shaft 69. Seat 91 is mounted upon a cross-bar 95 which extends between the lower edges of I-beams 25 and 27 between seat 89 and transmission 61. When the front leg 79 is coupled to the seat 91, the leg 79 extends between I-beams 25 and 27, between I-beams 35 and 37, and between transmission 61 and seat 89.

The stabilizing assembly 21 includes a front pad 97 and a rear pad 99. Each of these pads have arms 101 and 103 which angle from the pad to a pivotal connection to I-beams 25 and 27 adjacent the cross-bar 95. The arms 101 and 103 are angled to the pads 97 and 99, respectively, such that the pads are horizontal when lowered to a ground level. Hydraulic cylinders 105 and 107 are connected, respectively, between pads 97 and 99 and frame 13. These cylinders raise and lower the pads 97 and 99. The ends of the cylinders 105 and 107 are pivotally connected to allow the raising and lowering motions.

When the pads 95 and 97 have been lowered to engage the ground surface and to stabilize the frame 13, screw jacks 109, 111, 113 and 115 are extended between the edges of the pads and the frame 13 to provide a fixed and level orientation of the frame 13. Screw jacks 109 and 111 extend between the edges of pad 97 and the front plate 31 while screw jacks 113 and 115 extend between the edges of pad 99 and rear plate 29. For optimum leveling the screw jacks are positioned at the corners of the box 33.

The pad 99 comprises a rectangular frame 117 of bars from which the arms 103 angularly extend. A flat plate 119 is connected to the bottom of the rectangular frame and reinforcing members 121 extend across the interior of the frame. The screw jacks 113 and 115 can be connected to the pad frame or reinforcement bars by chains 123 and 125 and laid within the pad frame during transportation of the pump jack 11. Pad 97 is of similar construction.

To actuate the hydraulic cylinders 87, 105 and 107, three hydraulic valves 116 are mounted on I-beam 27 just behind I-beam 37. A hydraulic pump 118 is mounted on I-beam 35 just beneath engine 57 and supplies hydraulic fluid under pressure through conduits regulated by valves 116. Each of the three valves 116 actuates a different one of the cylinders 87, 105 and 107.

To supply fuel to the diesel engine 57, a fuel tank 127 is disposed in the forward portion of box 33. If more fuel capacity is desired an additional fuel tank can be positioned in the rear portion of box 33. These fuel tanks are connected by fuel lines to the engine 57. By locating the fuel tanks within box 33, they are protected during transportation.

To transport the pump jack 11, drive arms 63 and 65 are rotated to a lowered position and then chained to beams 25 and 27 by chains 129 and 131. These chains have a hook at their free ends which can be hooked through an eyelet at the ends of arms 63 and 65. The arms 63 and 65 extend below box 33 in their lowest point of travel and the chains 129 and 131 extend downwardly from box 33 to hold the arms 63 and 65 in a slightly forward position.

To lower the support assembly 17, the coupling pin 93 is removed and the leg 79 is removed from seat 89. The hydraulic cylinder 87 is actuated to lower the leg 79 into seat 91. Pin 93 is then inserted to fix leg 79 in seat 91.

When the support assembly 17 is lowered, yoke 67 comes to rest on a column 133. This positions the walking beam in a low-profile, near horizontal position. Preferably, the height of the walking beam should be minimized by angling the beam to make the highest points on each end horizontal with respect to the ground. Column 133 is mounted upon beam 35 and extends to approximately the height of engine 57.

To raise the pads 97 and 99 for transportation, the screw jacks 109, 111, 113 and 115 are removed from between the frame 13 and their respective pads. The screw jacks are then laid in the pad frames. Hydraulic cylinders 105 and 107 are actuated to raise pads 105 and 107. Of course, the front of the pump jack 11 must be either blocked or connected to a towing vehicle when the front pad 97 is raised.

To connect the pump jack to a towing vehicle, the towing vehicle is moved so that a towing hitch can be received by the front of beams 35 and 37. Preferably, the front of beams 35 and 37 is equipped with a standard receptacle of the type used on commercial trailers.

With the above preparations the portable pump jack of the present invention can be quickly transported by a towing vehicle to almost any well location. The walking beam in the lowered position is sufficiently low to travel beneath most bridges. All of the moving elements of the pump jack are secured while being retained as a single unit. The elongated nature of the pump jack is such that it can travel over roads without the hazard of being over-wide.

During transportation a typical walking beam pump jack constructed in accordance with the present invention is approximately 8 feet wide, 28 feet long and 13½ feet tall. When raised to a pumping position the walking beam is 15 feet tall at its midportion and 18 feet tall at its highest stroke.

The rear plate 29 can have lights mounted thereon for signalling stopping and turning. These lights are standard for all vehicles and can be connected for actuation to a towing vehicle by means of standard cables which extend through the box 33 and the forward end of beams 35 and 37.

To prepare the pump jack 11 for pumping after transportation, the pads 97 and 99 are lowered; the screw jacks 109, 111, 113 and 115 are positioned and extended to level the frame; the support assembly 17 is raised and leg 79 is coupled to seat 89; and chains 129 and 131 are unhooked. These steps are essentially the reverse of the steps required to prepare for transportation.

Both preparation for transport and preparation for pumping are quickly achieved because the heavy equipment procedures are accomplished by hydraulic cylinders. The cylinders and the pump jack are all powered by a single, self-contained engine.

From the above description it can be seen that the portable walking beam pump jack of the present invention is well adapted to attain the objects and advantages mentioned as well as those inherent therein. While presently preferred embodiments of the invention have been described for the purpose of this disclosure, numerous changes in the construction and the arrangement of parts can be made by those skilled in the art, which changes are encompassed within the spirit of this invention as defined by the appended claims.

What is claimed is:

1. A portable walking beam pump jack for use in pumping liquids from an oil well, comprising:

an elongated frame having a longitudinal axis and front and rear ends, said frame also including first and second support seats disposed at vertically spaced apart locations between said front end and said rear end of said frame;

a towing receptacle extending from the front end of said frame for connecting said frame to a towing vehicle;

an axle connected transversely across said frame;

ground engaging wheels connected to said axle for supporting said frame for rolling transportation;

stabilizing means for securing said frame with respect to a ground location;

a walking beam having a first end, a midportion and a second end, said second end being adapted for connection to a pumping rod;

an engine mounted on said frame;

a pair of arms counterweighted for balancing a pumping rod connected to said walking beam, journalled for rotation in parallel planes adjacent to said frame and parallel to said longitudinal axis of said frame, and connected to said engine for rotation responsive to said engine;

a drive yoke extending from said drive arms to said first end of said walking beam, rotation of said arms thereby driving said walking beam in a rocking motion;

a support assembly foldably mounted on said frame and upon which said midportion of said walking beam is pivotally connected, said support assembly said arms and said drive yoke being foldable together, from a first, fixed position in which said walking beam arms and yoke are supported in a raised position for rocking in a pumping motion to a second, fixed position disposed downwardly and forwardly from said first fixed position and in which said walking beam arms and yoke are held in a lowered position for transportation; said support assembly including:

a rear support having first and second ends, said first end being connected to the midportion of said walking beam and said second end being pivotally connected to said rear end of said frame for pivotal, arcuate movement of said rear support in a plane parallel to said longitudinal axis of said frame; and a front support having first and second ends, said first end of said front support being connected to the midportion of said walking beam, and said second end of said front support being movable between said first support seat for holding said support assembly in said first, fixed position and said second seat for holding said support assembly in said second, fixed position; and hydraulic cylinder means connected between said frame and said support assembly for moving said support assembly between said first, fixed position and said second fixed position.

2. The walking beam pump jack of claim 1 which further comprises:

horizontal support means for supporting said walking beam in an approximate horizontal, low profile, position when said support assembly is disposed in said second, fixed position.

3. The walking beam pump of claim 1 wherein said stabilizing means comprises:

first and second pads hydraulically extendable from said frame to a ground surface location; and means for fixing said first and second pads in an extended position in engagement with a ground surface.

* * * * *